US008096722B2

(12) United States Patent
Rolion et al.

(10) Patent No.: US 8,096,722 B2
(45) Date of Patent: Jan. 17, 2012

(54) WRITING INSTRUMENT WITH RETRACTABLE TIP

(75) Inventors: Franck Rolion, Belloy-en-France (FR); Frédéric Duchesne, Frepillon (FR)

(73) Assignee: Societe BIC, Clichy Cedex (FR)

( * ) Notice: Subject to any disclaimer, the term of this patent is extended or adjusted under 35 U.S.C. 154(b) by 1298 days.

(21) Appl. No.: 11/568,678

(22) PCT Filed: Apr. 15, 2005

(86) PCT No.: PCT/FR2005/000919

§ 371 (c)(1),
(2), (4) Date: Apr. 28, 2007

(87) PCT Pub. No.: WO2005/120861

PCT Pub. Date: Dec. 22, 2005

(65) Prior Publication Data

US 2007/0223986 A1 Sep. 27, 2007

(30) Foreign Application Priority Data

May 4, 2004 (FR) ..... 04 04775

(51) Int. Cl.
*B43K 5/16* (2006.01)

(52) U.S. Cl. ..... 401/106; 401/104; 401/105

(58) Field of Classification Search ..... 401/104–106, 401/109, 112, 113
See application file for complete search history.

(56) References Cited

U.S. PATENT DOCUMENTS

| | | | | |
|---|---|---|---|---|
| 2,427,069 | A | 9/1947 | Randolph | |
| 2,881,736 | A | 4/1959 | Zepelovitch | |
| 3,071,112 | A | 1/1963 | Love Joy at al. | |
| 3,146,758 | A * | 9/1964 | Zepell | 401/106 |
| 3,179,088 | A | 4/1965 | Johmann | |
| 3,181,507 | A * | 5/1965 | Dannebaum | 401/99 |
| 3,920,337 | A | 11/1975 | Ganz | |
| 4,717,275 | A * | 1/1988 | Burkhardt, Jr. | 401/104 |
| 4,973,179 | A | 11/1990 | Nakazato et al. | |
| 5,074,694 | A | 12/1991 | Nakazato et al. | |
| 6,309,122 | B1 * | 10/2001 | Wang | 401/112 |

FOREIGN PATENT DOCUMENTS

| | | |
|---|---|---|
| DE | 12 84 878 B | 12/1968 |
| DE | 29 34 084 A | 3/1981 |
| EP | 0 337 447 A | 10/1989 |

* cited by examiner

*Primary Examiner* — David Walczak
(74) *Attorney, Agent, or Firm* — Jones Day

(57) ABSTRACT

A writing instrument that includes a barrel, which includes a window in the side of the barrel, a movable writing tip, a moving member that is connected to the tip, and a side button designed to collaborate with the moving member. The moving member can be moved through the window between a first position, where the tip is retracted and the second position, where the tip is exposed.

15 Claims, 4 Drawing Sheets

WRITING INSTRUMENT WITH RETRACTABLE TIP

This application is a national stage application of PCT/FR2005/00919, filed on Apr. 15, 2005.

FIELD OF INVENTION

The embodiments of the present invention relate to a writing instrument with a retractable tip.

BACKGROUND OF INVENTION

More specifically, the embodiments of the present invention relate to a writing instrument comprising:

- a barrel extending along a longitudinal axis between a rear end and a front end provided with an opening, and having a window in the a side of the barrel;
- a writing tip that can move between an exposed position in which the tip emerges through the opening and a retracted position in which the tip is housed within the barrel;
- a moving member connected to the writing tip; and
- a side button designed to collaborate with the moving members which can be moved in a radial direction through the window between a first position for which the writing tip is retracted and a second position for which the tip is kept exposed.

This type or writing instrument usually, but not necessarily is comprised of a ball-point pen, the side button of which has a clip so that the pen can be secured to a pocket of a shirt, for example. When the side button is in the second position it is generally pressed into the barrel of the pen, such that the clip cannot be used, which means the pen cannot be secured to a garment when the ball point is still exposed.

The writing tip needs to be kept exposed reliably and firmly enough for it not to retract when this is not wanted, particularly if the user exerts significant pressure on the tip or if he or she drops the pen onto a table or onto the floor. However actuation of the side button needs to remain simple and intuitive enough for the user that the writing instrument is practical to use and does not require particular dexterity or explanations as to how to expose or retract the writing tip.

For example, document EP A 0337447 discloses a retractable ball point pen of the aforementioned type, in which the side button, which comprises a clip, acts on the moving member equipped with inclined ramps in order to expose the writing tip. In order to keep the tip exposed, the side button has, at its front end, a tab 10*a* which becomes housed under a retaining part 13 so as to keep the side button in the pushed-in position. However, the locking thus achieved can be exerted only by exerting pressure on the front part of the side button, whereas it is necessary to exert pressure on the rear part of the side button in order to unlock and retract the tip. These special conditions for actuating the side button are not known to the user, which means that the writing instrument comprising such a mechanism may prove somewhat impractical to use. In addition, incorrect actuation of the side button may lead to deformation or wear of the tab 10*a* and of the corresponding parts of the moving member, which means that the locking achieved with an element that does not protrude very far may become unreliable and lead to unwanted retraction of the writing tip.

SUMMARY OF INVENTION

An object of the embodiments of the present invention is to remedy the disadvantages mentioned above by providing a mechanism with a side button that allows the writing tip to be kept in the exposed position reliably while at the same time retaining a mode of actuation of the side button which is simple and intuitive.

To this end, the subject of the embodiments of the present invention is a writing instrument of the aforementioned type, characterized in that the side button comprises a guide in which a locking member can move between a side-button unlocked position and a side-button locking position, in which it engages with a retaining element arranged in the barrel and for which the side button is immobilized with respect to the barrel, the locking member being urged, at least when the side button is in the second position, towards the locking position.

Providing a moving locking member makes it possible to achieve positive and reliable locking of the side button when the latter is in the second position, that is to say when the writing tip is exposed. In addition, the fact that the locking member is urged towards the locking position avoids recourse to somewhat complicated manipulation of the side button in order to keep the tip in the exposed position, because the locking member automatically moves into the locking position when the side button is moved into the second position.

In preferred embodiments of the present invention recourse is further had to one an, or an other of the following arrangements:

- the retaining element is firmly secured to the barrel;
- the guide for the side button is a housing extending along, the longitudinal axis and having, at one end, an opening through which the locking member slides along the longitudinal axis in order to engage with the retaining element;
- the locking member has a first end designed to engage with the retaining element and a second end in contact with the moving member when the side button is in the second position, the moving member being urged by an elastic member towards the first end of the locking member, so as to urge the locking member towards the locking position;
- the side button comprises a longitudinally-extending stud which is designed to engage with a rim of the moving member when the side button is in the second position;
- the second end of the locking member is designed to move the moving member from a position in which the rim thereof is engaged with the stud of the side button into a position in which the rim is no longer in engagement with the stud, when the locking member is moved from the locking position to the unlocked position;
- the side button comprises a clip and the window is arranged near the rear end of the barrel, the clip being at least partially housed in the barrel when the side button is in the second position;
- an unlocking button, that can be moved with respect to the barrel, is designed to drive the locking member from the side-button locking position into the unlocked position;
- the unlocking button is firmly secured to the locking member and slides along a slot in the barrel.
- the unlocking button slides through an opening in the barrel and has an interior end able to come into contact with the locking member so as to move the latter from the locking position into the unlocked position,
- the unlocking button is mounted to slide alone the longitudinal axis in a housing formed at the rear end of the barrel and has an interior end which slides through an opening formed in the end of the housing;
- the unlocking button slides in a more or less radial direction and has an interior end in the shape of a cam which is designed to collaborate with the locking member so as to move the latter towards the unlocked position when the unlocking button is depressed:

the unlocking button is mounted to slide through an opening in the side button.

BRIEF DESCRIPTION OF DRAWINGS

In the various figures, the same references are kept to denote identical or similar elements.

DETAILED DESCRIPTION OF DRAWINGS

Figure 1:
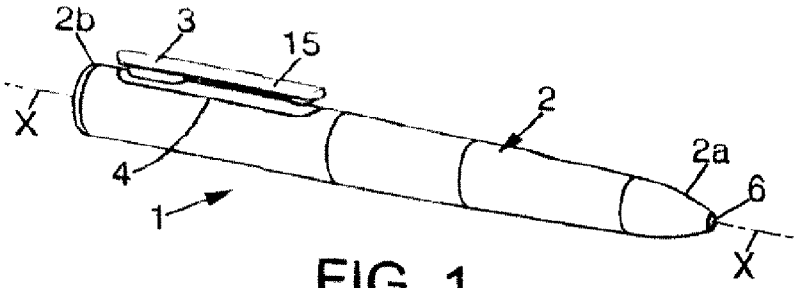
FIG. 1 is a perspective view of a first embodiment of a writing instrument according to the present invention, the writing tip of which is in the a retracted position.
Figure 2:
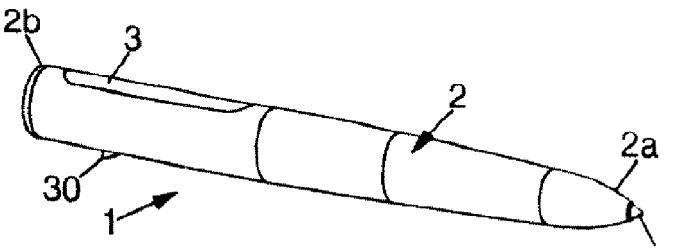
FIG. 2 is a view similar to FIG. 1, in which the writing tip is exposed.

FIGS. 1 and 2 are a perspective view of a writing instrument 1 of the ball-point pen type, comprising a barrel 2 extending along a longitudinal axis X between a font end 2*a* and a rear end 2*b*, and a side button 3 which passes through a side window 4 in the barrel. The pen also comprises a writing tip 5 that can move along the longitudinal axis X between a retracted position depicted in FIG. 1, in which the tip is housed inside the barrel, and an exposed position depicted in FIG. 2, in which the tip 5 emerges from the barrel through an opening 6 formed at the front end 2*a*.

The writing tip is a ball point in the embodiment depicted, but could be a felt tip or even a lead pencil from a cartridge including a propelling mechanism.

Figure 3:
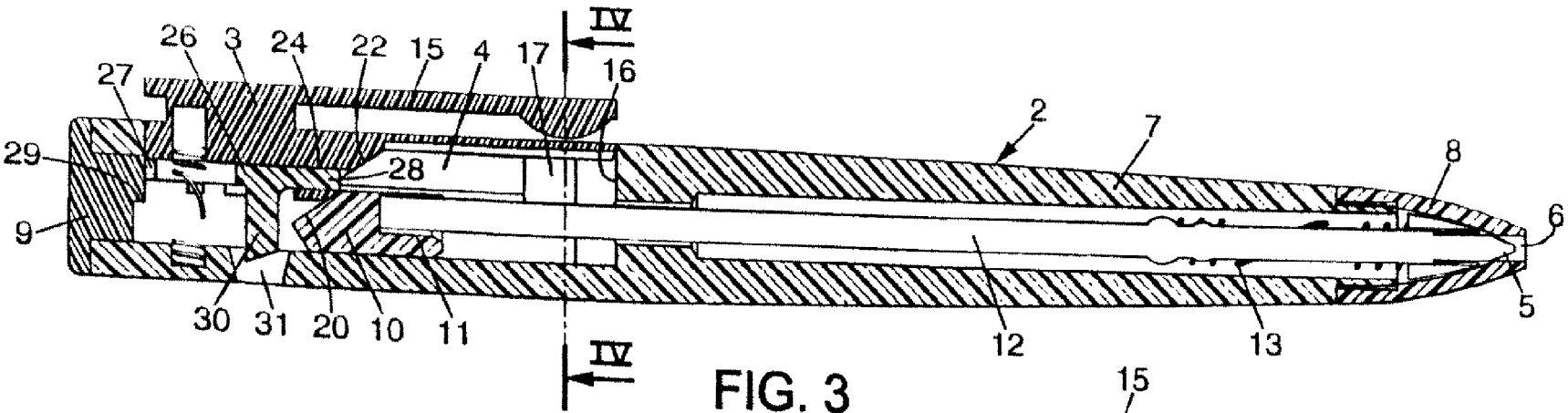
FIG. 3 is a view of the writing instrument depicted in FIG. 1.

As can best be seen in FIG. 3, the barrel 2 comprises a central tubular body 7 equipped with a conical point 8 at its front end and a plug 9 at its rear end.

A moving member 10 is arranged inside the barrel 2 such as to slide along the longitudinal axis X. The moving member has, at the front end, a recess 11 designed to accommodate the rear end of an ink reservoir 12, the front end of which is fixed to the writing tip 5, which means that the moving member 10 is connected to the writing tip 5.

A helical compression spring 13, arranged between the front point 8 of the barrel and a bulge in the ink reservoir 12, urges the reservoir, and therefore the moving member 10, towards the rear end 2*b*. However, the moving member could be urged in the same direction by any other elastic member, such as a slotted plastic sleeve for example.

The side button 3 comprises a clip 15 which extends from a base in the continuation of the exterior face of the button towards the front end 2*a*.

Figure 4:
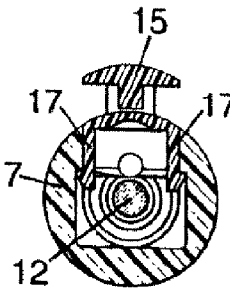
FIG. 4 is a view from the distal end of the writing tip, looking into the writing instrument at the IV point of FIG. 3.

The button 3 is mounted to slide through the window 4 delimited by a periphery 16 which runs over a certain distance measured in a radial direction with respect to the longitudinal axis X and has a rectangular cross section which means that the side button can be moved in an essentially radial direction between two positions. The button 3 has tabs 17 extending towards the inside of the barrel along the wall 16 of the window, and this guides the sliding of the button therethrough. The interior ends of the tabs 17 have a projection which collaborates with an interior longitudinal rim of the tubular body 2 to limit the outward movement of the button, as can be seen in FIG. 4.

In the first position, depicted in FIGS. 1 and 3, the side button projects from the exterior surface of the barrel 2 and the clip 15 is fully exposed. When the user presses against the exterior lace of the button 3, the latter slides towards the inside of the barrel until it reaches a second position, depicted in FIG. 6, in which the clip 15 is fully housed inside the window 4. The window 4 is tailored to the length and/or the shape of the clip 15 in order to accommodate the latter. The exterior surface of the button 3 and of the clip 15 then lie flush with the surface of the barrel, which means that the clip can no longer be clipped to a garment. However, the clip 15 could simply penetrate part of the way into the window in order to become unusable. In this configuration, the barrel 2 has an exterior surface that is continuous over most of its length and thus offers an easy grip.

Figure 6:
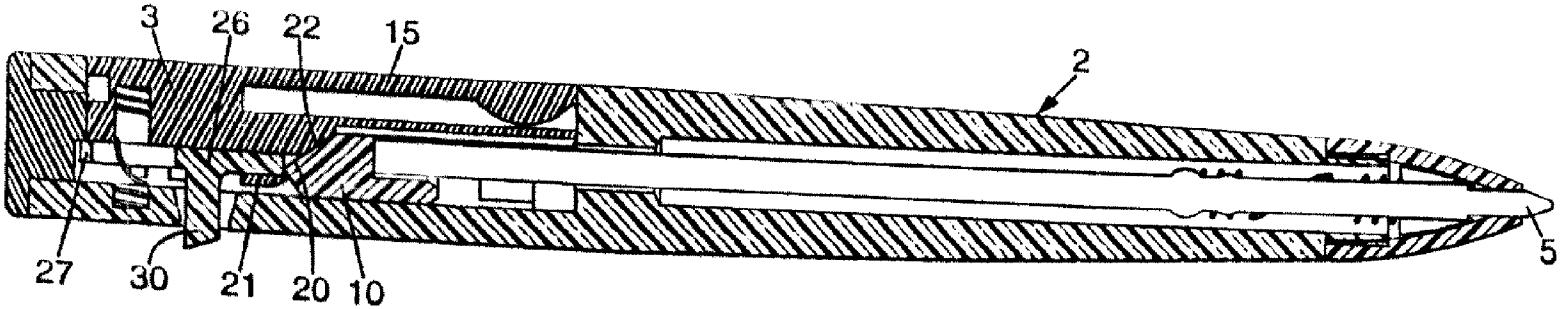
FIG. 6 is a view similar to FIG. 5, in which the writing tip is exposed.

During the movement from the first position to the second position, the side button collaborates in a known way with the moving member 10 so as to move the writing tip 5 from the retracted position depicted in FIG. 3, to the position depicted in FIG. 6 in which the writing tip is exposed. To this end, the moving member 10 has an inclined ramp 20 against which a portion 21 of the side button slides, as can be seen in FIGS. 3 and 4. When the side button 3 reaches the second position depicted in FIG. 6, an inclined face of the button comes to bear against the inclined ramp of the moving member 10, and this limits the amount of play that the moving member can enjoy. However, the collaboration between the button and the moving member could be achieved differently, for example using a stud sliding in a slot that is inclined with respect to the longitudinal axis.

The side button 3 has a housing 24 which extends along the longitudinal axis X between two open ends. In the first embodiment, the housing 24 also comprises radial openings on the opposite side to the clip 15 and thus has a perforated configuration.

The housing 24 forms a guide in which a locking member 26 slides along the longitudinal axis X. The locking member 26 has the configuration of a rectangular platelet which has a first end 27 at the back end and a second end 28 at the opposite end to the first.

The first end 27 of the locking member does not cause the guide 24 of the side button 3 to project when this button is in the first position and during the sideways movement towards the second position. When the locking member 26 is in this second position, known as the unlocked position, the side button 3 is therefore free to slide through the window 4, the first end 27 of the locking member also sliding against the wall 16 delimiting the window.

When the side button 3 is in the second position depicted in FIG. 6, the locking member 25 adopts a locking position under the action of an influence detailed hereinbelow. In the locking position, the first end 27 engages with a retaining element 29, which means that the side button can no longer slide outwards in spite of the force exerted in this direction by an additional spring 23 arranged between the side button and the internal wall of the tubular body 7 facing the window 4, and possibly by the pressure exerted by the moving member 10 on the inclined face 22 of the side button. This movement of the locking member makes it possible to obtain strong collaboration between the end 27 and the retaining element 29 and this ensures that the side button is held reliably in the second position, and therefore ensures that the writing tip 5 is held reliably in the exposed position, all this without requiring any movement of the side button 3 other than the movement in the radial direction.

It will be noted that the locking member 26 performs a translational movement along the longitudinal axis X towards the rear in order to adopt the locking position in the embodiments depicted; however, it is conceivable for the locking member to perform a different movement, for example a movement in a radial direction perpendicular to the movement of the side button, or alternatively a movement of pivoting about an axis parallel to the direction of travel of the side button. In this case, the guide in which the locking member is mounted would have a shape appreciably different from the housing 24.

The retaining element 29 is a projection formed in the barrel plug 9, which extends longitudinally towards the front end 2*a*. However, the retaining element could consist of a rim of the moving member, with which rim the first end of the locking member would collaborate. Nevertheless, collaboration of the locking member 26 with an element firmly secured to the barrel limits the play between the components of the mechanism, thus enhancing the reliability of the locking.

Figure 5:
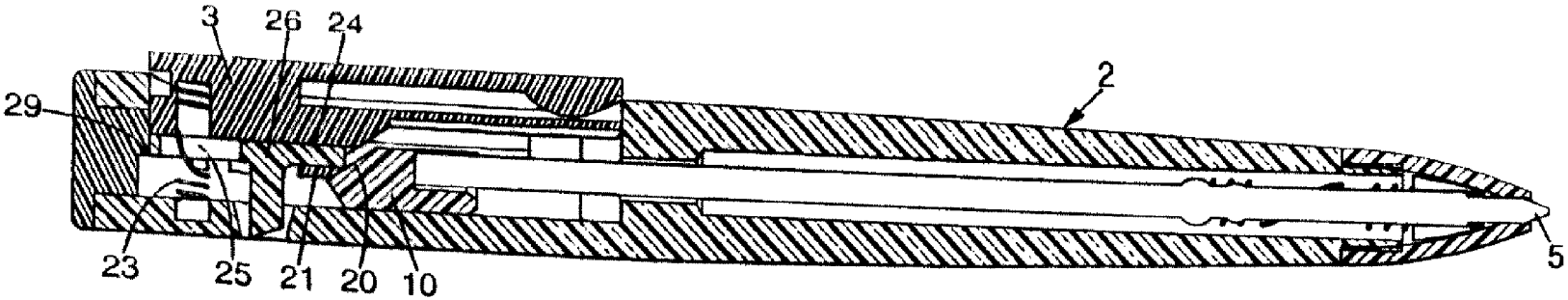
FIG. 5 is a view similar to FIG. 3, in which the writing tip is partially exposed.

In order to move from the unlocked position depicted in FIGS. 3 and 5 to the locking position depicted in FIG. 6, the locking member 26 is urged towards the locking position when the side button 3 approaches the second position. What actually happens is that the second end 28 of the locking member 26 protrudes slightly from the second opening in the housing 24, which second opening is situated between the portion 21 of the side button which comes into contact with the inclined ramp 20 of the moving member 10 as the side button is depressed, and the inclined face 22 of the side button which comes to bear against the inclined ramp 20 when the side button reaches the second position depicted in FIG. 5. Thus, when the portion 21 protrudes beyond the lower end of the inclined ramp 20, the latter comes to bear against the second end 28 of the locking member under the action of the spring 13, and urges the locking member 26 towards its locking position, that is to say that the moving member 10 tends to cause the locking member to slide toward the first end 27 thereof.

As a result of this arrangement, there is no need to resort to an additional elastic means in order to automatically urge the member 26 towards the locking position. However, recourse to such an urging means, for example a compression spring arranged between the locking member and an end of the housing in the side button, or an elastic tab formed as an integral part of the locking member and which would bear against a wall of housing in the side button, is not precluded.

It will be noted that the portion 21 of the side button constitutes a stud which extends longitudinally forward and has an active face corresponding to the mouth of the second opening of the housing 24. Furthermore, the lower end of the ramp 20 of the moving member 10 forms a rim with which the stud 21 engages when the side button reaches the second position depicted in FIG. 6. Collaboration between the stud 21 and the rim of the moving member 10 forms a second locking point for locking the side button 3 in the second position, and therefore a second locking point for locking the writing tip in the exposed position, in addition to the first locking point that is formed by the collaboration between the first end 17 of the locking member and the retaining element 29 of the barrel. This then yields a particularly reliable way of keeping the writing tip in the exposed position.

In order to retract the writing tip from the position depicted in FIG. 6, provision is made for the writing instrument 1 to be equipped with an unlocking button 30 which allows action to be exerted on the locking member 26 in order to move it from the side-button 3 locking position to the unlocked position, and to do so against the pressure towards the locking position exerted on the locking member.

In the first embodiment, the unlocking button 30 is produced in the form of a peg secured firmly to the locking member 26, which extends in a radial direction towards a slot 31 made in the barrel 2 on the opposite side to the window 4. The slot 31 extends along the longitudinal axis X of the barrel. The length of the peg that forms the unlocking button 30 is designed so that this peg projects through the slot when the side button 3 is in the second position. The slot 31 is of course long enough that action exerted on the unlocking button 30 causes the unlocking member 26 to move from the locking position into the unlocked position. It will be noted that the unlocking button 30 is visible only when the writing tip is exposed, which makes its actuation in order to retract the tip more intuitive.

Figure 7:
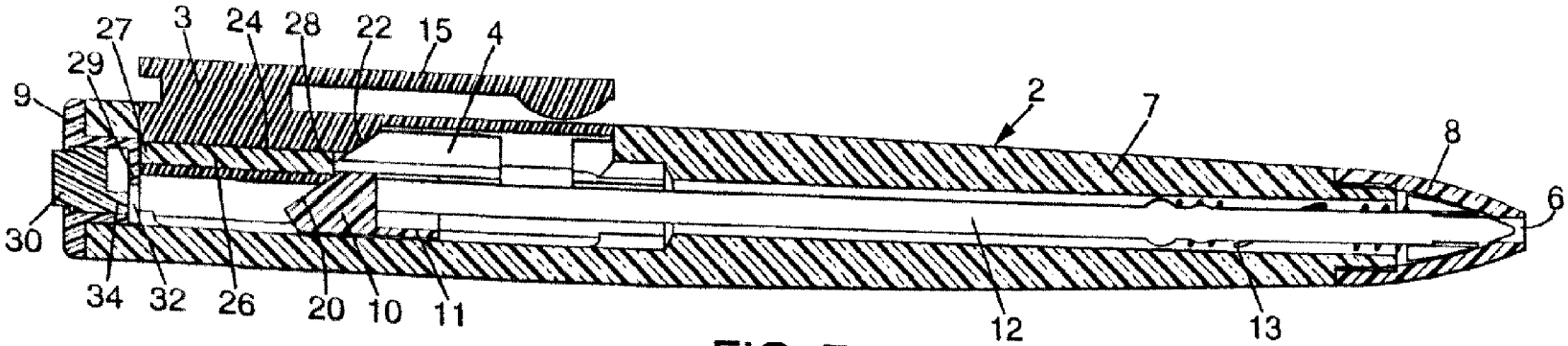
FIG. 7 is a view cross sectional of a second embodiment of the writing instrument according to the present invention.
Figure 8:
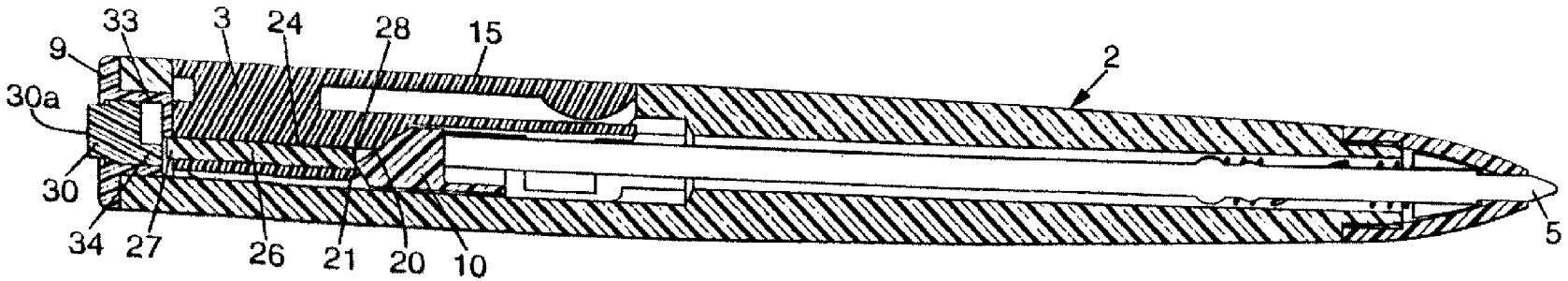
FIG. 8 is a view similar to FIG. 7, in which the writing tip is exposed.

A second embodiment of the writing instrument according to the present invention is depicted in FIGS. 7 and 8. Most of the elements in this embodiment are the same as in the first embodiment and will not be detailed again. It will simply be noted that the housing 24 in the side button 3 has a more closed configuration than that of the previous embodiment. Specifically, for this second embodiment, the housing 24 merely has openings at its longitudinal ends. Furthermore, it will be noted that this second embodiment does not have an additional spring to assist the side button 3 in returning to its first position. This is because collaboration between the inclined ramp 20 of the moving member 10 and the second end 28 of the locking member 26, then the portion 21 of the side button, under the action of compression spring 13, is able to instigate the radial movement of the side button 3 towards the first position and is able to keep it in this position.

For this second embodiment, the unlocking button 30 is produced in an appreciably different way by comparison with the first embodiment, because in this case it is an element distinct from the locking member 26. The unlocking button 30 is mounted to slide along the longitudinal axis X in a housing 33 formed in the cap 9 of the barrel. The housing 33 in its wall adjacent to the side button 3 has an opening 32 situated facing the first end 27 of the locking member 26 when the latter is in the locking position. The button 30 has an interior end 34 formed by a peg which comes into contact with the first end 27 and moves the locking member 26 from the locking position into the unlocked position when pressure is exerted, for example with the thumb, on the exterior face 30*a* of the unlocking button which projects at the rear end 2*b* of the barrel. As writing instruments are often equipped with a push-button at their rear end, it is fairly natural for the user to exert pressure on the unlocking button 30 of this second embodiment in order to retract the writing tip.

Figure 9:
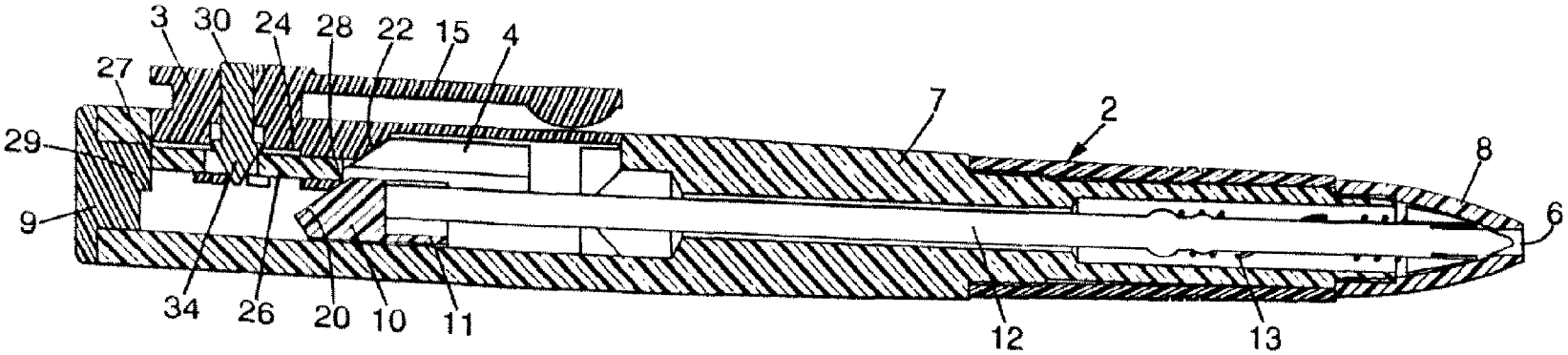
FIG. 9 is a view cross sectional of a third embodiment of the writing instrument according to the present invention.
Figure 10:
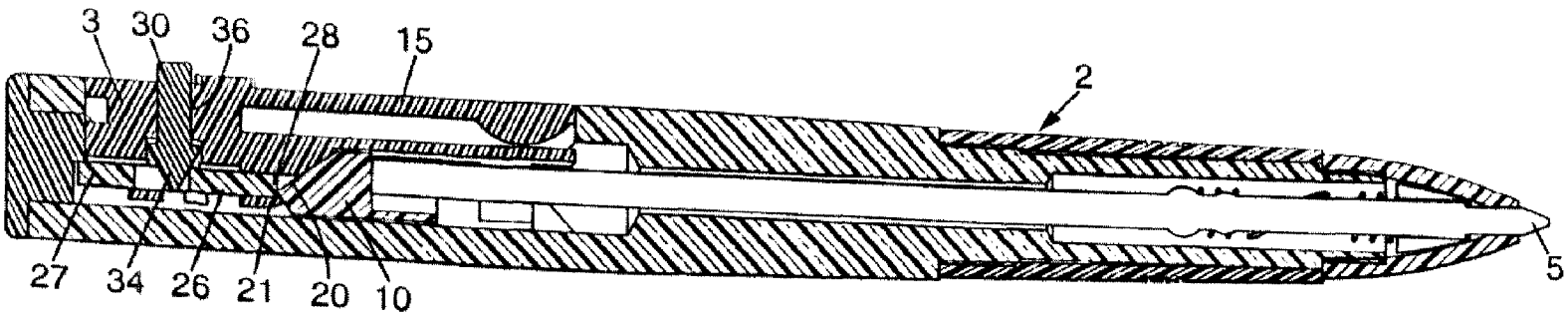
FIG. 10 is a view similar to FIG. 9, in which the writing tip is in the exposed.

In a third embodiment depicted in FIGS. 9 and 10 and which repeats most of the elements of the first and second embodiments, the unlocking button 30 is also formed of a component distinct from the locking member 26. In this third embodiment, the unlocking button slides in a radial direction through a passage 36 which passes through the side button 3 from its exterior face as far as the housing 24. The passage 36 forms an opening allowing action within the barrel 2 via the unlocking button 30. The interior end 34 of the unlocking button has a conical point that forms a cam. This interior end 34 collaborates with the locking member 26, and more specifically with an opening 25 thereof, so that depressing the unlocking button by exerting pressure on its exterior face causes the locking member to move from the locking position depicted in FIG. 10 into an unlocked position as depicted in FIG. 9.

A similar embodiment could be achieved by mounting the unlocking button 30 to slide in a radial direction through an opening made in the tubular body 7 opposite the window 5 and with an identical interior end 34 again collaborating with the opening 25 of the locking member 26 by making a suitable side opening onto the housing 24. However, the layout depicted in FIGS. 9 and 10 makes it possible to produce a functional subassembly comprising the side button 3, the locking member 26 and the unlocking button 30 which can be pre-assembled then mounted on the tubular body 7 simply by inserting this assembly through the window 4.

It will be noted that when the side button 3 is in the second position depicted in FIG. 10, the edge of the opening 25 urges the conical portion of the unlocking button 30 outwards and causes this button to protrude more noticeably.

In order to expose the writing tip 5 in the various embodiments depicted, the user exerts pressure on the side button 3 or clip 15 starting from the positions depicted in FIGS. 3, 7 and 9. The side button 3 then exerts pressure against the inclined ramp 20 of the moving member 10, and this causes the moving member 10, the ink reservoir 12 and the writing tip 5 to slide longitudinally towards the front end 2*a* of the barrel. When the side button 3 approaches its second position, that is to say shortly after the position depicted in FIG. 5*l* the portion 21 of the side button protrudes beyond the lower end of the inclined ramp 20, which lower end then comes into contact with the second end 28 of the locking member 26 and urges the latter toward its first end 27 under the action exerted by the compression spring 13. When the side button 3 reaches the second position depicted in FIGS. 6, 8 and 10, the first end 27 of the locking member 26 protrudes beyond the retaining element 29 of the barrel and slides towards the rear end 2*b*, which means that the first end 27 engages in the retaining element 29, thus creating a first locking point. It will be noted that the portion 21 of the side button 3 forms a stud which engages with the lower end of the inclined ramp 20 and thus forms a second locking point locking the side button.

In order to retract the writing tip 5 into the barrel, the user either performs a longitudinal translational movement on the unlocking button 30 in the first embodiment, or presses against the exterior face of the unlocking button in the second and third embodiments, and this causes the locking member 26 to move from the locking position depicted in FIGS. 6, 8 and 10 into an unlocked position, that is to say a position with respect to the side button 3 that is identical to the position depicted in FIGS. 3, 7 and 9. In the unlocked position, the first end 27 of the unlocking member is disengaged from the retaining element 29, while the second end 28 pushes the lower end of the inclined ramp 20 back and covers the stud 21 of the side button, which means that this is no longer engaged with the moving member 10. Because of the pressure exerted by the inclined ramp of the moving member and possibly aided by the additional spring 31, the side button moves back to its initial position.

Of course, the various embodiments described are not in any way limiting, and in particular it is possible to combine various features of these embodiments without departing from, the scope of the present invention.

The invention claimed is:

1. A writing instrument comprising:

a barrel extending along a longitudinal axis X between a rear end and a front end provided with an opening, wherein said barrel includes a window;

a writing tip that can move between an exposed position in which said writing tip emerges through the opening and a retracted position in which said writing tip is housed within said barrel;

a moving member connected to said writing tip; and a side button that collaborates with said moving member, said side button capable of moving in a general radial direction through the window between a first position in which said writing tip is retracted and a second position in which said writing tip is exposed, wherein said side button includes a guide in which a locking member can move between an unlocked position and a locked position, wherein, in said locked position, the locking member engages with a retaining element arranged in said barrel and for which said side button is immobilized with respect to said barrel, the locking member being urged, at least when said side button is in the second position, towards the locked position.

2. The writing instrument according to claim 1, wherein the retaining element is firmly secured to said barrel.

3. The writing instrument according to claim 1, wherein the guide includes a housing extending along the longitudinal axis X and having, at one end, an opening through which the locking member slides along the longitudinal axis X in order to engage with the retaining element.

4. The writing instrument according to claim 1, wherein the locking member includes a first end that engages with the retaining element and a second end in contact with said moving member when said side button is in the second position, said moving member being urged by an elastic member towards the first end of the locking member, so as to urge the locking member towards the locked position.

5. The writing instrument according to claim 4, wherein said side button includes a longitudinally-extending stud that engages a rim of said moving member when said side button is in the second position.

6. The writing instrument according to claim 5, wherein the second end of the locking member is capable of moving said moving member from a position in which the rim is engaged with the stud into a position in which the rim is no longer in engagement with the stud, when said locking member is moved from the locked position to the unlocked position.

7. The writing instrument according to claim 1, wherein said side button comprises a clip and wherein the window is arranged near the rear end of said barrel, the clip being at least partially housed in said barrel when said side button is in the second position.

8. The writing instrument according to claim 1, further comprising an unlocking button that is capable of being moved with respect to said barrel to drive the locking member from the locked position into the unlocked position.

9. The writing instrument according to claim 8, wherein the unlocking button is firmly secured to the locking member and slides along a slot in said barrel.

10. The writing instrument according to claim 8, wherein the unlocking button slides through an opening in said barrel and has an end capable of coming into contact with the locking member so as to move the locking member from the locked position into the unlocked position.

11. The writing instrument according to claim 10, wherein the unlocking button is mounted to slide along the longitudinal axis X in a housing formed at the rear end of said barrel, and has an interior end which slides through an opening formed in the end of the housing.

12. The writing instrument according to claim 10, wherein the unlocking button slides in a general radial direction and has an interior end in the shape of a cam that collaborates with the locking member so as to move the locking member towards the unlocked position when the unlocking button is depressed.

13. The writing instrument according to claim 12, wherein the unlocking button is mounted to slide through an opening in said side button.

14. A writing instrument comprising:

a barrel extending along a longitudinal axis X between a rear end and a front end provided with an opening, wherein said barrel includes a window, a writing tip that can move between an exposed position in which said writing tip emerges through the opening and a retracted position in which said writing tip is housed within said barrel;

a moving member connected to said writing tip; and a side button that collaborates with said moving member, said side button capable of moving in a general radial direction through the window between a first position in which said writing tip is retracted and a second position in which said writing tip is exposed, wherein said side button includes a guide in which a locking member can move between an unlocked position and a locked position, wherein, in said locked position, the locking member engages with a retaining element arranged in said barrel, wherein said side button comprises a clip, and wherein the window is arranged near the rear end of said barrel, the clip being at least partially housed in said barrel when said side button is in the second position.

15. A writing instrument comprising:

a barrel extending along a longitudinal axis X between a rear end and a front end provided with an opening, wherein said barrel includes a window, a writing tip that can move between an exposed position in which said writing tip emerges through the opening and a retracted position in which said writing tip is housed within said barrel;

a moving member connected to said writing tip;

a side button that collaborates with said moving member, said side button capable of moving in a general radial direction through the window between a first position in which said writing tip is retracted and a second position in which said writing tip is exposed, wherein said side button includes a guide in which a locking member can move between an unlocked position and a locked position;

wherein, in said locked position, the locking member engages with a retaining element arranged in said barrel; and an unlocking button that is capable of being moved with respect to said barrel to drive the locking member from the locked position into the unlocked position, and wherein said unlocking button slides in a general radial direction and includes an interior end having a cam shape that collaborates with the locking member so as to move the locking member towards the unlocked position when said unlocking button is depressed.

* * * * *